United States Patent [19]

Boris et al.

[11] Patent Number: 4,932,915

[45] Date of Patent: Jun. 12, 1990

[54] BURSTING BALLOON WHICH EMBODIES TOYS AND RELATED ITEMS

[76] Inventors: Paul Boris; Sherri Boris, both of P.O. Box 9091, Truckee, Calif. 95737

[21] Appl. No.: 176,674

[22] Filed: Apr. 1, 1988

[51] Int. Cl.[5] ..... A63H 27/10

[52] U.S. Cl. ..... 446/75; 446/5; 446/475; 446/220

[58] Field of Search ..... 446/220, 221, 222, 224, 446/226, 475, 483, 5, 75, 397, 491; 272/27 N

[56] References Cited

U.S. PATENT DOCUMENTS

| | | | |
|---|---|---|---|
| 1,283,095 | 10/1918 | Cummiskey | 446/220 |
| 1,471,886 | 4/1923 | Dessau | 446/220 |
| 4,092,798 | 6/1978 | Oquita | 446/5 |
| 4,639,232 | 9/1987 | Wang | 446/220 |
| 4,704,934 | 11/1987 | Nosrati | 446/220 X |

FOREIGN PATENT DOCUMENTS

| | | | |
|---|---|---|---|
| 893680 | 4/1962 | United Kingdom | 446/220 |
| 1562815 | 3/1980 | United Kingdom | 446/5 |

*Primary Examiner*—Mickey Yu

[57] ABSTRACT

Toy pinata consisting of a balloon envelope into which toys, confetti, candy and other like items are embodied. The balloon envelope, when inflated and permenantly sealed to prevent the escape of the inflating gas, is subsequently pierced or punctured, which causes the balloon envelope to explode, which in turn showers the area in proximity of the exploding balloon with the contents embodied within the toy.

1 Claim, 2 Drawing Sheets sheet 1 of 2 sheet 2 of 2

BURSTING BALLOON WHICH EMBODIES TOYS AND RELATED ITEMS

BACKGROUND OF INVENTION

1. Field of Invention

This invention relates to a toy and particularily to a toy having an inflatable balloon envelope. The balloon envelope embodies toys, candy, confetti, serpintine like material, and other items. The balloon envelope is inflated, sealed to retain it's inflated state, and punctured which results in an explosion of the balloon envelope. The exploding balloon envelope ejects the embodied contents of the balloon envelope toy.

2. Description of Prior Art

Balloon Envelopes emodying toy and other items are known in the arts. U.S. Pat. No. 4,639,232 discloses an inflatable toy with a moving mechanical toy as it's contents. U.S. Pat. No. 1,471,886 consists of a balloon envelope embodying a toy hanging by a string which is attached to the balloon envelope. U.S. Pat. No. 1,283,095 consists of a balloon envelope with several bells embodied within, which, when the balloon envelope is inflated and sealed, allows the bells to make musical sounds when the toy is bounced or shook.

SUMMARY OF THE INVENTION

An object of the invention is to provide a novel toy which includes an inflatable and rupturable envelope embodying smaller items, inclusive but not limited to, toys, candy, serpintine like material, and other related items, which, upon the inflation and rupturing of the balloon envelope, causing an explosion of the balloon envelope, which in turn ejects most of the aforementioned embodied items from the exploding balloon envelope.

Another object of this invention is to provide for a length of string which protrudes from the inflating mouth opening of the balloon envelope. One end of the length of string is permanently attached to an item embodied within the balloon envelope. The other end of the string is passed through the inflating mouth opening of the balloon envelope and extends into space outside of the balloon envelope. The length of string becomes permanently attached to the balloon envelope upon the inflation of the balloon envelope and the sealing of the inflating mouth opening of the balloon envelope to prevent the escape of the inflating gas, thusly entraping and rendering the string enclosed within the sealed mouth opening of the balloon envelope immobile. The length of string extending outward from the sealed mouth opening of the inflated balloon envelope may be employed to affix, tie, or hang the inflated toy in any suitable fashion or location.

The present invention and embodiment will be described in detail with reference to the accompaning drawings.

DRAWING REFERENCE NUMERALS

1 balloon envelope toy
2 wall of 1
3 string
**3*a* embodied end of 3**
**3*b* other end of 3**
4 inflating mouth opening of 1
5 items embodied in 1
7 sealed area of 4
9 puncturing of 1

DETAILED DESCRIPTION OF THE PREFERRED EMBODIMENT

Figure 1:
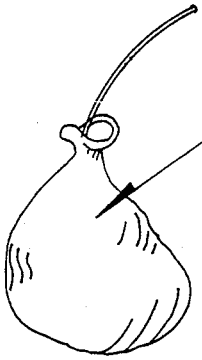
FIG. 1 is a view of the toy in a deflated state according to the present invention.
Figure 2:
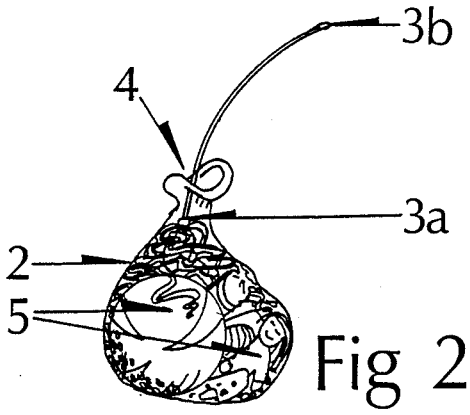
FIG. 2 is a view of a cross section of the toy in a deflated state according to the present invention.

The preferred embodiment of the invention are illustrated with reference to the drawings in which the same elements are represented by the same reference numbers, Referring to FIG. 1 and FIG. 2, there is shown an inflatable toy 1 in a deflated state, said toy consisting of an envelope comprised of a flexible wall material 2. A string 3 protrudes through and out of the inflating mouth opening 4 of the balloon envelope 1. Embodied within the balloon envelope 1 are a plurality of items 5. While the invention will be described hereinafter as embodying items 5, it is to be understood that the items 5 embodied within the invention are inclusive of but not limited to, toys, candy, confetti, serpintine and other similar material, buttons, pins, games, money, advertising or other printed material, articles of clothing, and other related items. One end **3*a* of said string 3 is permanently attached to an item 5 embodied within the balloon envelope 1, the other end 3*b* of said string 3 passes through the inflating mouth opening 4 of the balloon envelope 1 and extends outside of the balloon envelope 1**.

Figure 3:
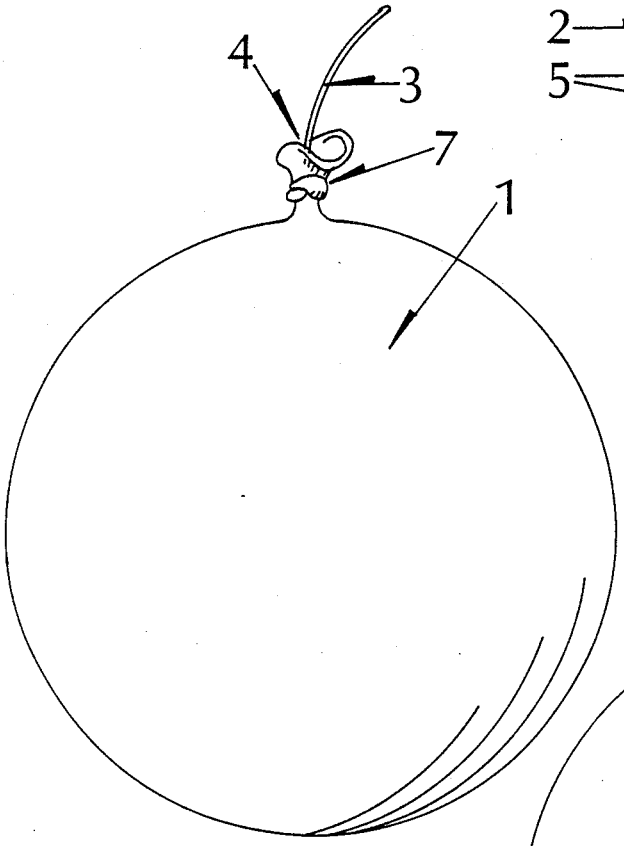
FIG. 3 is a view of the toy in an inflated state according to the present invention.
Figure 4:
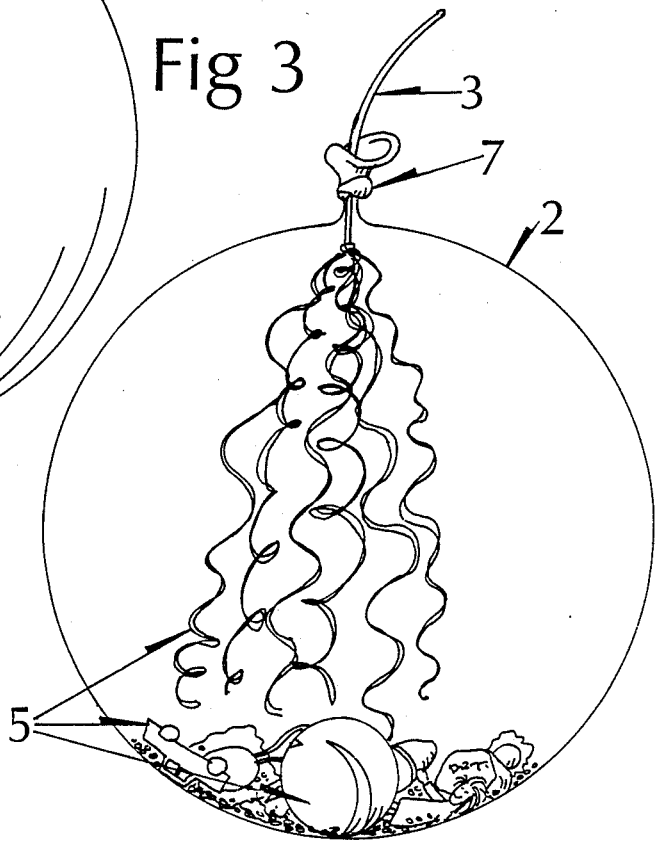
FIG. 4 is a view of a cross section of the toy in an inflated state, revealing toys, candy, confetti, and other items embodied within the balloon envelope, and also showing the permanently attached string which may be utilized in securing the toy to any location.

Referring to FIG. 3 and FIG. 4, once the balloon envelope 1 has been inflated with gas, the inflating mouth opening 4 of the balloon envelope 1 has been sealed 7 to prevent the escape of the inflating gas. The string 3, which is permanently attached to an item 5 embodied within the balloon envelope 1, extends through and continues past the neck and mouth opening 4 of the balloon envelope 1. Due to the pinching of the neck material in the sealing process 7 of the balloon envelope 1, the string 3 is rendered immobile and becomes permanently attached to the balloon envelope 1 at the point of the sealing 7 of the balloon envelope 1. The string 3 may now be employed, due to it's permenant attachment to the balloon envelope 1, for affixing the inflated toy 1 to any desireable location for such affixing. Referring to FIG. 4, the interior of the balloon envelope 1, due to the inflation and expansion of the balloon envelope 1, allows the items which are embodied within the inflated balloon envelope 1, unrestained movement within the balloon envelope 1.

Figure 5:
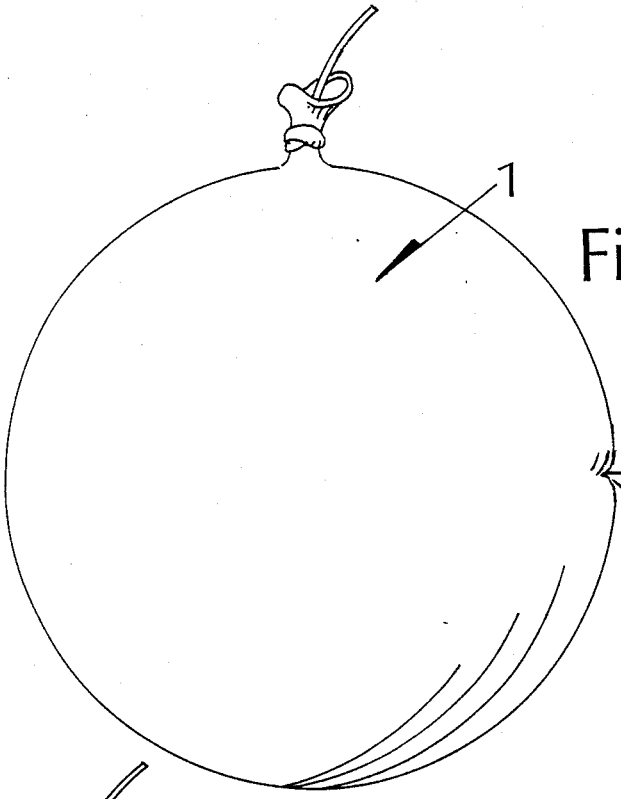
FIG. 5 is a view simulating the initial puncturing of the inflated toy, which starts the process of an explosion of the balloon envelope.
Figure 6:
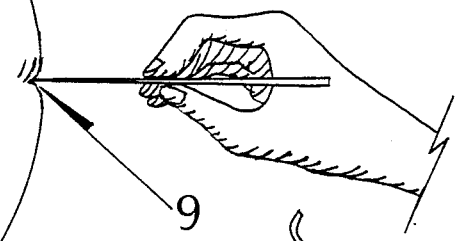
FIG. 6 is a view of the simulated explosion of the toy, whereby most of the items that were embodied within the inflated toy are ejected due to said explosion.
Figure 6:
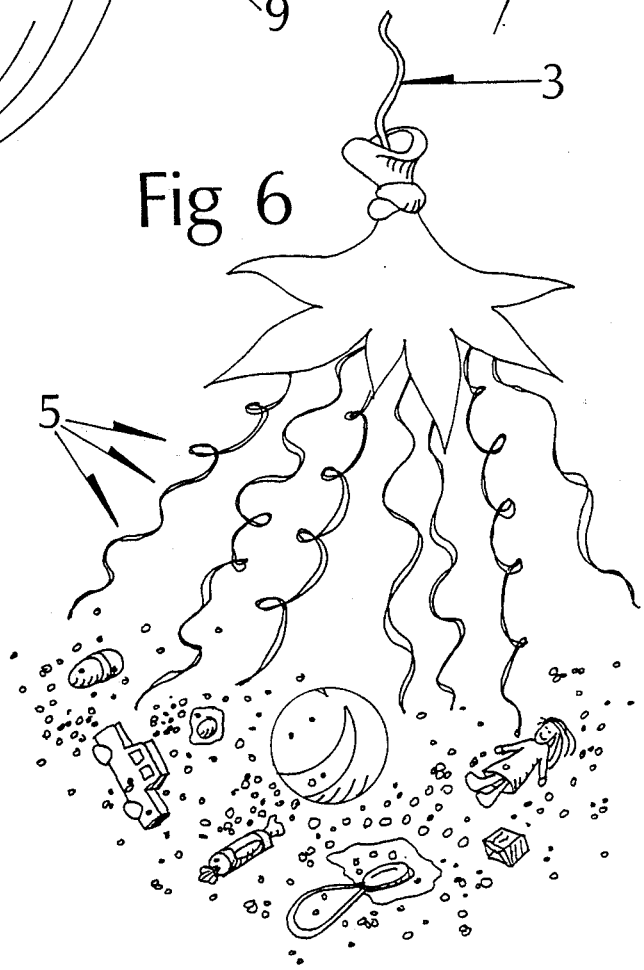

Referring to FIG. 5 and FIG. 6, as the wall 2 of the inflated and sealed balloon envelope is initially punctured 9, the internal inflating gas, which is under pressure, causes the wall 2 of the balloon envelope 1 to explode. Referring to FIG. 6, as the wall 2 of the balloon envelope 1 ruptures, causing said explosion of the toy 1, the items 5 previously embodied within the balloon envelope 1 are ejected.

Figure 7:
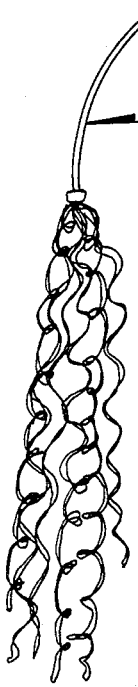
FIG. 7 is a view of the toy after the rupturing and exploding of the balloon envelope, and which in this view shows the remaining string which is still permanently attached to a formerly embodied item.

Referring to FIG. 7, the string 3 remains permanently attached to an item 5 formerly embodied within the balloon envelope toy 1. With the invention thus explained, it is apparent that various modifications and variations can be made without departing from the scope of the invention. It is therefore intended that the invention be limited as indicated in the claim.

I claim:

1. A balloon pinata comprising:

an inflatable elastic balloon envelope having a neck and a mouthpiece;

a plurality of items contained in said balloon envelope, whereby when said balloon envelope is inflated with a pressurized gas, an expanded chamber is formed, and when said balloon envelope is consequently ruptured by a player, said pressurized gas escapes in an explosive manner and instantaneously disbursing said items from said chamber; and a string independent of said balloon envelope, said string having one end attached to at least one item and received within the interior of said balloon envelope and having an intermediate portion passing through said neck and mouthpiece of said balloon envelope and extending to a second end exterior of said balloon envelope, said string becoming a permanently attached and an integral part of said balloon envelope as said balloon envelope is sealed at said neck causing said intermediate portion of said string to become entrapped in said neck and effectively attaching said string to said balloon envelope allowing ease in the suspending of said balloon pinata to a support.

* * * * *